US005086744A

United States Patent [19]

Ishihara et al.

[11] Patent Number: 5,086,744

[45] Date of Patent: Feb. 11, 1992

[54] FUEL CONTROL SYSTEM FOR INTERNAL COMBUSTION ENGINE

[75] Inventors: Toshihiro Ishihara; Tetsushi Hosokai; Tetsuro Takaba; Hideki Kobayashi, all of Hiroshima, Japan

[73] Assignee: Mazda Motor Corporation, Hiroshima, Japan

[21] Appl. No.: 639,263

[22] Filed: Jan. 10, 1991

[30] Foreign Application Priority Data

Jan. 12, 1990 [JP] Japan ..... 2-5911
Jan. 16, 1990 [JP] Japan ..... 2-7934

[51] Int. Cl.[5] ..... F02M 51/00; F02D 41/30

[52] U.S. Cl. ..... 123/480; 123/494

[58] Field of Search ..... 123/357, 358, 359, 381, 123/557, 590, 492, 493, 480, 494, 478

[56] References Cited

U.S. PATENT DOCUMENTS

| | | | |
|---|---|---|---|
| 4,105,003 | 8/1978 | Funk | 123/590 |
| 4,112,889 | 9/1978 | Harpman | 123/557 |
| 4,357,923 | 11/1982 | Hideg | 123/480 |
| 4,388,906 | 6/1983 | Sugiyama et al. | 123/480 |
| 4,452,212 | 6/1984 | Takase | 123/493 |
| 4,454,847 | 6/1984 | Isomura et al. | 123/480 |
| 4,665,877 | 5/1987 | Manaka et al. | 123/472 |
| 4,716,879 | 1/1988 | Takayama et al. | 123/472 |
| 4,792,905 | 12/1988 | Sekozawa et al. | 123/478 |
| 4,805,577 | 2/1989 | Kanno et al. | 123/492 |
| 4,852,538 | 8/1989 | Nagaishi | 123/492 |
| 4,896,644 | 1/1990 | Kato | 123/493 |
| 4,898,142 | 2/1990 | Van Wechem et al. | 123/557 |
| 4,903,668 | 2/1990 | Ohata | 123/480 |
| 4,919,094 | 4/1990 | Manaka et al. | 123/493 |
| 4,922,876 | 5/1990 | Mizoguchi et al. | 123/590 |
| 4,984,553 | 1/1991 | Kako et al. | 123/492 |
| 4,986,242 | 1/1991 | Bonfiglioli et al. | 123/480 |

FOREIGN PATENT DOCUMENTS 58-8238 1/1983 Japan .

*Primary Examiner*—Andrew M. Dolinar
*Assistant Examiner*—Thomas N. Moulis
*Attorney, Agent, or Firm*—Sixbey, Friedman, Leedom & Ferguson

[57] ABSTRACT

A fuel control system for an engine has a fuel injector which injects fuel into an intake passage communicating with a combustion chamber. The quantity of a direct delivery part of fuel injected from the fuel injector which is directly fed to the combustion chamber is estimated, the quantity of a drawn part of fuel which has been on a wall surface of the intake passage and is vaporized and fed to the combustion chamber together with the direct delivery part is estimated, and the quantity of fuel to be injected from the fuel injection means is dcetermined on the basis of the estimated quantities of the direct delivery part and the drawn part so that the sum of them provides a desired quantity of fuel to be fed to the combustion chamber. The estimated quantity of at least one of the direct delivery part and the drawn part is increased as a factor which governs the degree of evaporation of the fuel on the wall surface changes in such a direction as to promote evaporation of the fuel on the wall surface.

9 Claims, 17 Drawing Sheets

1

S51
τrst ≧ Krst ?
NO
YES
S52
Ftinhn ← 0
τeLN ← τeN
S53
Ftinhn ← 1
S54
Tinjn ← 0
S55
Tendn ← τeLN + τV
S56
Finjn ← 1
S57
INJECTION
S58
S42
Ftinhn ← 0
τeTN ← τeN
S43
Rinjn ← 1-(τeLN/τeN)
S59
τaLN ← (1-Rinjn)· τa
S60
τeLN ← αL · τeLN + βL · τmn
S61
S44
τeLN ≧ Ktmn ?
NO
YES
S48
τeLN ← Ktmn
τmLN ← (1- αL)· τeLN + (1-Rinjn)·(1-βL)·τmn
S62
RETURN

FUEL CONTROL SYSTEM FOR INTERNAL COMBUSTION ENGINE

BACKGROUND OF THE INVENTION

1. Field of the Invention

This invention relates to a fuel control system for an internal combustion engine, and more particularly to a fuel control system for a fuel injection type internal combustion engine.

2. Description of the Prior Art

In a fuel injection type internal combustion engine, a basic quantity of fuel to provide a desired air-fuel ratio is calculated according to the quantity of intake air for each cycle and the fuel is injected into the intake system of the engine in the basic quantity for each cycle.

However this method of feeding fuel is disadvantageous in the following point. That is, the fuel cannot be sufficiently vaporized and atomized, and a relatively large part of the fuel injected for each cycle adheres to the wall surface of the intake passage and does not enter the combustion chamber though a part of the fuel vaporizes and enters the combustion chamber during the next injection. Accordingly, the quantity of the fuel actually fed to the combustion chamber for each cycle largely deviates from the required quantity, which can deteriorates the operating performance of the engine and can give rise to a problem in emission control.

In Japanese Unexamined Patent Publication No. 58(1983)-8238, there is disclosed a method of controlling the quantity of fuel to be injected in which the quantity of fuel which is actually fed to the engine is determined on the basis of both the direct delivery part and the drawn part, the former being the part of the fuel to be directly delivered to the combustion chamber from the fuel injector and the latter being the part of the fuel which has adhered to the wall surface of the intake passage, and is vaporized and fed to the combustion chamber. In accordance with this method, the quantity of the fuel to be injected is determined taking into account both the direct delivery part and the drawn part, and accordingly the quantity of the fuel actually fed to the combustion chamber for each cycle approximates to the required quantity. (Such correction of the basic fuel injection quantity will be referred to as "the wet correction", hereinbelow.)

However, since the wet correction is based on estimate of the quantities of the direct delivery part and the drawn part, satisfactory result of the wet correction cannot be expected unless the quantities of the direct delivery part and the drawn part can be precisely estimated. The quantity of the drawn part greatly depends upon various factors which govern the degree of evaporation such as the length of the period during which the fuel vaporizes, the temperature of the fuel itself, the temperature of the wall surface, the quantity of the fuel which has been on the wall surface (will be referred to as "the intake-manifold wetting fuel", hereinbelow) and the like. For example, even if the quantity of the intake-manifold wetting fuel is the same, the quantity of the drawn part increases where the period during which the fuel vaporizes is long and more part of the intake-manifold wetting fuel vaporizes. The intake passage is generally formed by casting and cast wall surface is not smooth and has uneveness, and accordingly, a part of the intake-manifold wetting fuel enters the recesses and stays therein. When the quantity of the intake-manifold wetting fuel is small, contact of the fuel in the recesses with airflow passing through the intake passage becomes worse and the degree of evaporation is lowered, and less fuel is directly delivered to the combustion chamber since the injected fuel directly collides against the uneven wall surface. As a result, the quantity of the intake-manifold wetting fuel increases and the quantities of the direct delivery part and the drawn part are reduced.

In the method disclosed in the above identified Japanese unexamined patent publication, none of the factors which govern the degree of evaporation is taken into account, and accordingly, when the actual vaporizing condition differs from the presupposed condition, satisfactory wet correction cannot be effected.

SUMMARY OF THE INVENTION

In view of the foregoing observations and description, the primary object of the present invention is to provide a fuel control system for an engine which can effect satisfactory wet correction irrespective of change in the vaporizing condition of fuel.

In accordance with the present invention, there is provided a fuel control system for an engine having a fuel injection means which injects fuel into an intake passage communicating with a combustion chamber, in which the quantity of a direct delivery part of fuel injected from the fuel injection means which is directly fed to the combustion chamber is estimated, the quantity of a drawn part of fuel which has been on a wall surface of the intake passage and is vaporized and fed to the combustion chamber together with the direct delivery part is estimated, and the quantity of fuel to be injected from the fuel injection means is determined on the basis of the estimated quantities of the direct delivery part and the drawn part so that the sum of them provides a desired quantity of fuel to be fed to the combustion chamber characterized by having a vaporizing condition detecting means which detects at least one of factors which govern the degree of evaporation of the fuel on the wall surface, and a changing means which increases the estimated quantity of at least one of the direct delivery part and the drawn part as the factor changes in such a direction as to promote evaporation of the fuel on the wall surface.

As the factor which governs the the degree of evaporation of the fuel on the wall surface, the length of the period during which the fuel vaporizes, the temperature of the fuel itself, the temperature of the wall surface, the quantity of the intake-manifold wetting fuel and the like may be employed.

DESCRIPTION OF THE PREFERRED EMBODIMENT

Figure 1:
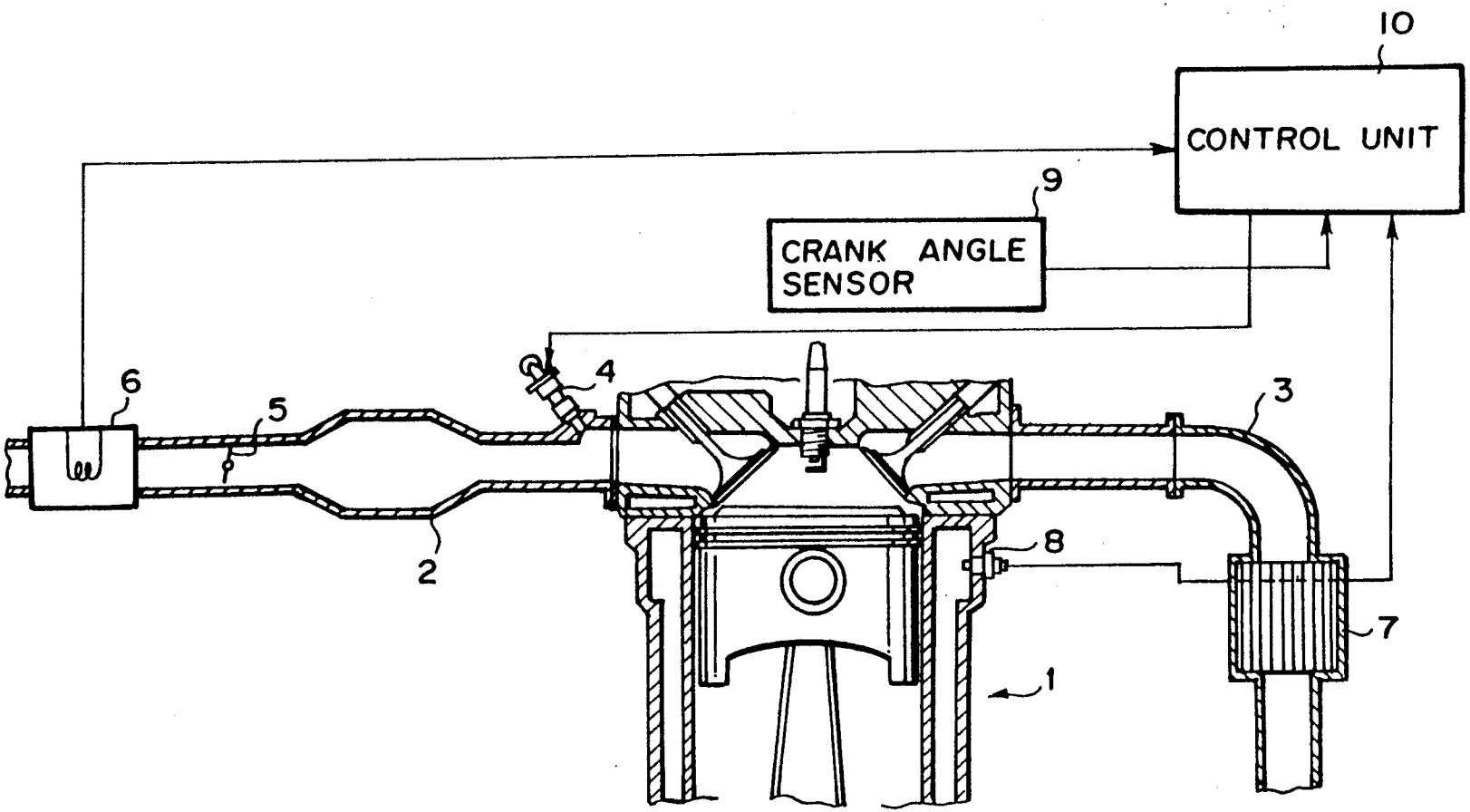
FIG. 1 is a schematic view showing an engine provided with a fuel control system in accordance with an embodiment of the present invention.

In FIG. 1, an engine 1 is provided with a fuel control system in accordance with an embodiment of the present and has an intake passage 2 and an exhaust passage 3. A fuel injector 4, a throttle valve 5 and an airflow meter 6 are provided in the intake passage 2, and a catalytic convertor 7 is provided in the exhaust passage 3. Further the engine 1 is provided with an engine coolant temperature sensor 8 and a crank angle sensor 9.

Output signals of the airflow meter 6, the engine coolant temperature sensor 8 and the crank angle sensor 9 are input into a control unit 10. The control unit 10 calculates the quantity of fuel to be injected from the fuel injector 4 on the basis of estimated quantities of the direct delivery part and the drawn part which are determined taking into account the period during which the intake-manifold wetting fuel on the wall surface of the intake passage 2 is permitted to vaporize before the vaporized fuel is fed to the combustion chamber as the factor which governs the degree of evaporation of the fuel. In this embodiment, the period is detected through the fuel injection timing, that is, as the fuel injection timing is advanced, the period during which the intake manifold wetting fuel on the wall surface of the intake passage 2 is permitted to vaporize is elongated and the proportion of the drawn part to the total quantity of fuel actually fed to the combustion chamber increases.

In this embodiment, a so-called divided fuel injection is employed and fuel is injected partly in the intake stroke and partly in the power stroke.

The basic control concept of the present invention will be briefly described with reference to FIG. 24 prior to detailed description of the fuel control by the control unit 10.

Figure 24:
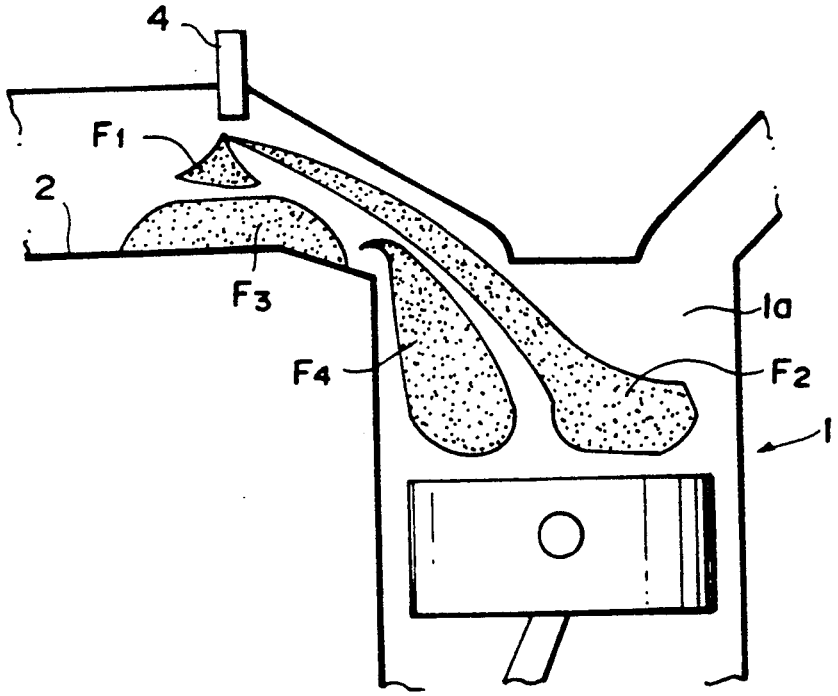
FIG. 24 is a view for illustrating the principle of the fuel control system of the present invention.

As shown in FIG. 24, a part F1 of fuel injected from the fuel injector 4 adheres to the wall surface of the intake passage 2 and the other part F2 of the fuel is directly introduced into the combustion chamber 1a. The part F1 which adheres to the wall surface of the intake passage 2 is referred to as "the adhering part" and the part F2 which is directly introduced into the combustion 1a is "the direct delivery part" defined before. A part F4 of fuel F3 which has adhered to the wall surface of the intake passage 2 is vaporized and is introduced into the combustion chamber 1a together with the direct delivery part F2 at each injection and the other part of the fuel F3 remains there. The former part F4 is is "the drawn part" defined before and the latter part is referred to as "the residual part". The fuel F3 which has adhered to the wall surface of the intake passage 2 is "the intake-manifold wetting fuel" defined before, and comprises the adhering part F1 of the fuel injected by the preceding injection and the residual part of the intake-manifold wetting fuel at the preceding injection. Accordingly, in order to effect the wet correction taking into account the drawn part, the quantity of the intake manifold wetting fuel on the basis of which the quantity of the drawn part is calculated must be calculated on the basis of the quantity of the adhering part of fuel injected in the preceding injection and the quantity of the residual part of the preceding adhering part. In this embodiment, calculations are effected on the basis of such a concept.

The wet correction is effected on the basis of the proportion of the direct delivery part $\alpha$ and the proportion of the drawn part $\beta$ which are determined on experiment. In this embodiment the estimated values of the drawn part and direct delivery part are changed according to the fuel injection timing.

Figure 3A:
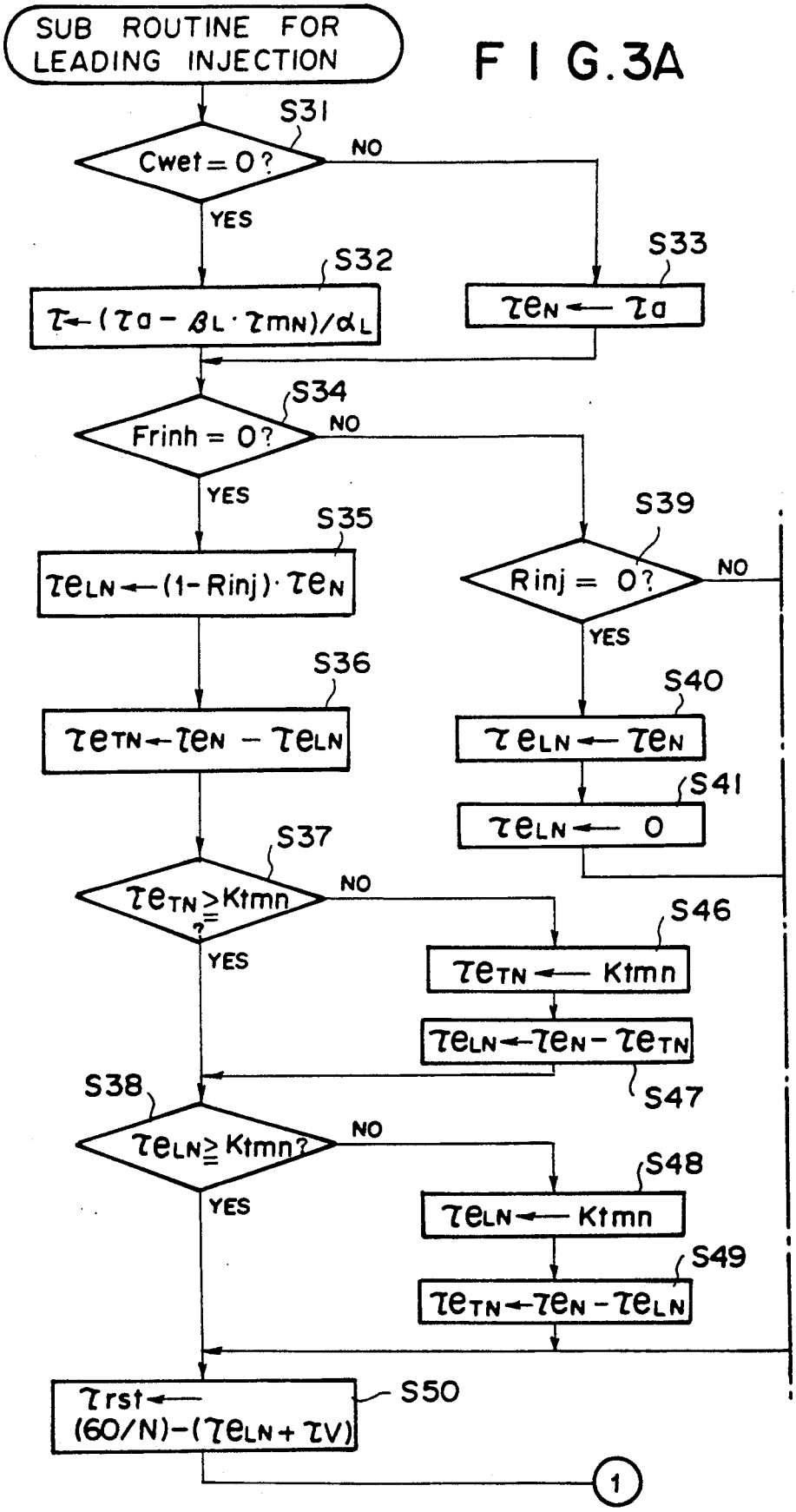
FIGS. 3, 3A and 3B are flow chart showing a sub routine which the control unit executes for the leading injection for a N-th cylinder.
Figures 3, 3A, 3B:
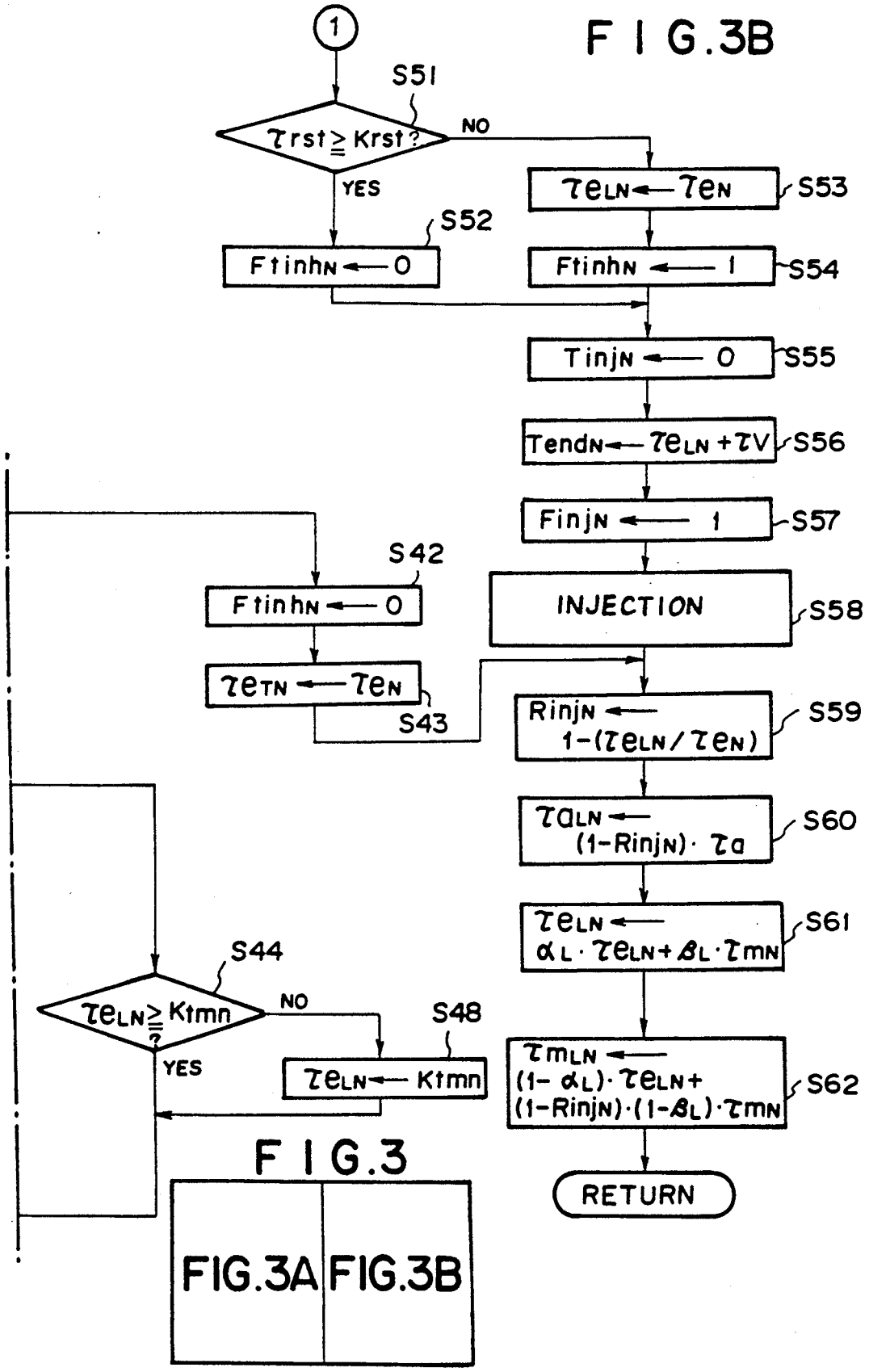
Figure 4A:
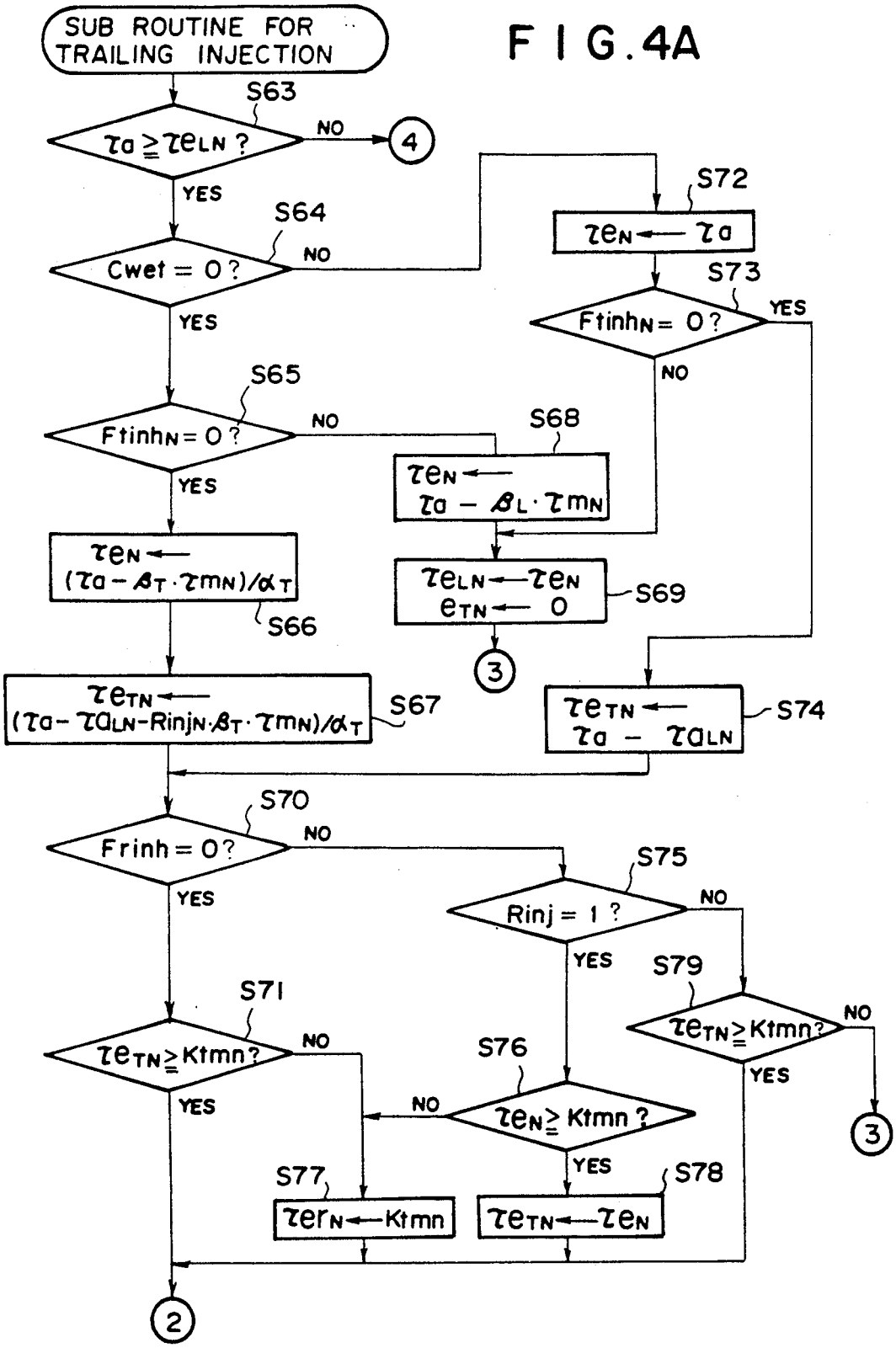
FIGS. 4A, and 4B are flow charts showing a sub routine which the control unit executes for the trailing injection for the N-th cylinder.
Figure 4B:
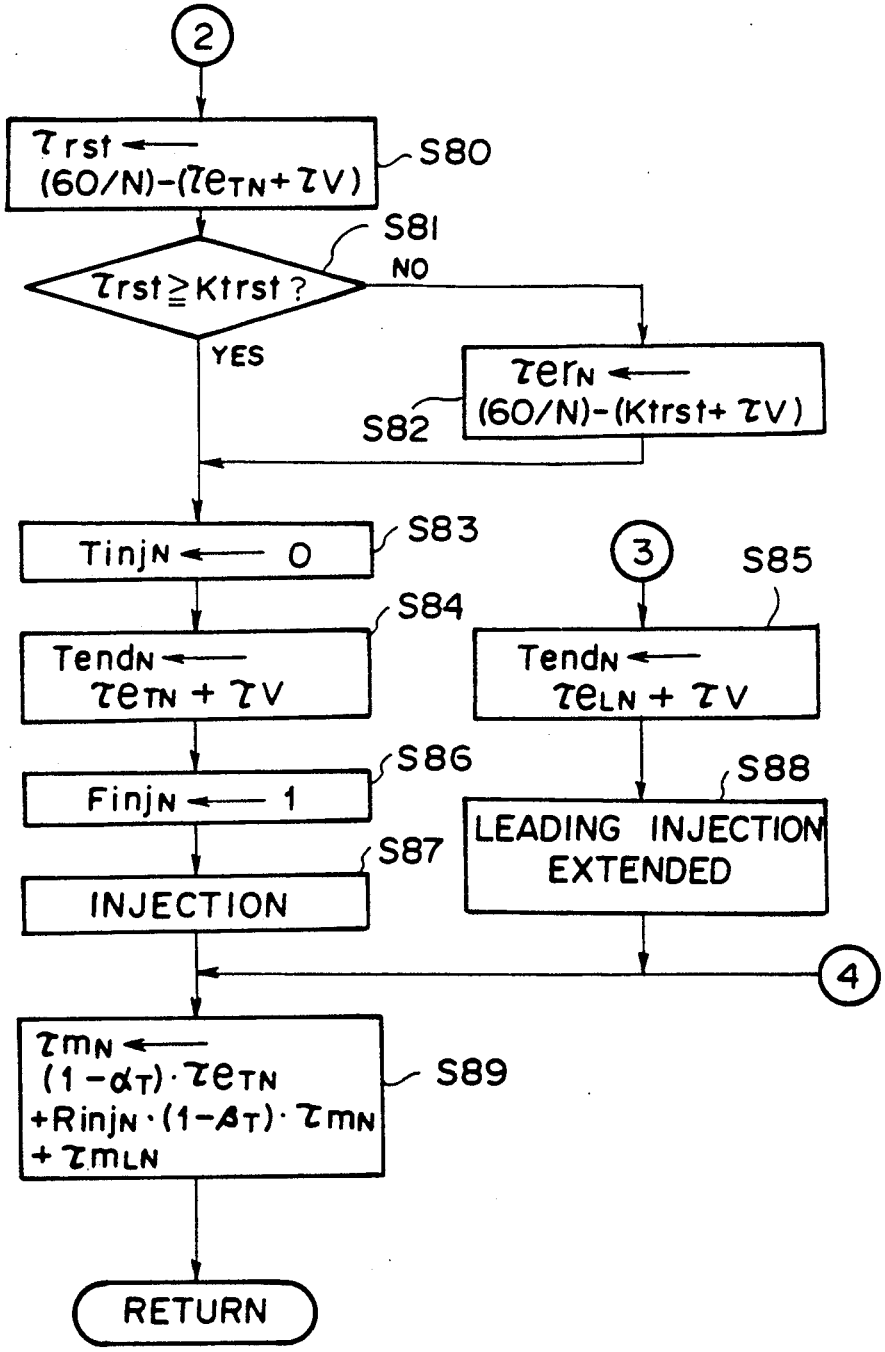

Now the fuel control which the control unit 10 executes will be described in detail with reference to FIGS. 2 to 4.

Figure 2A:
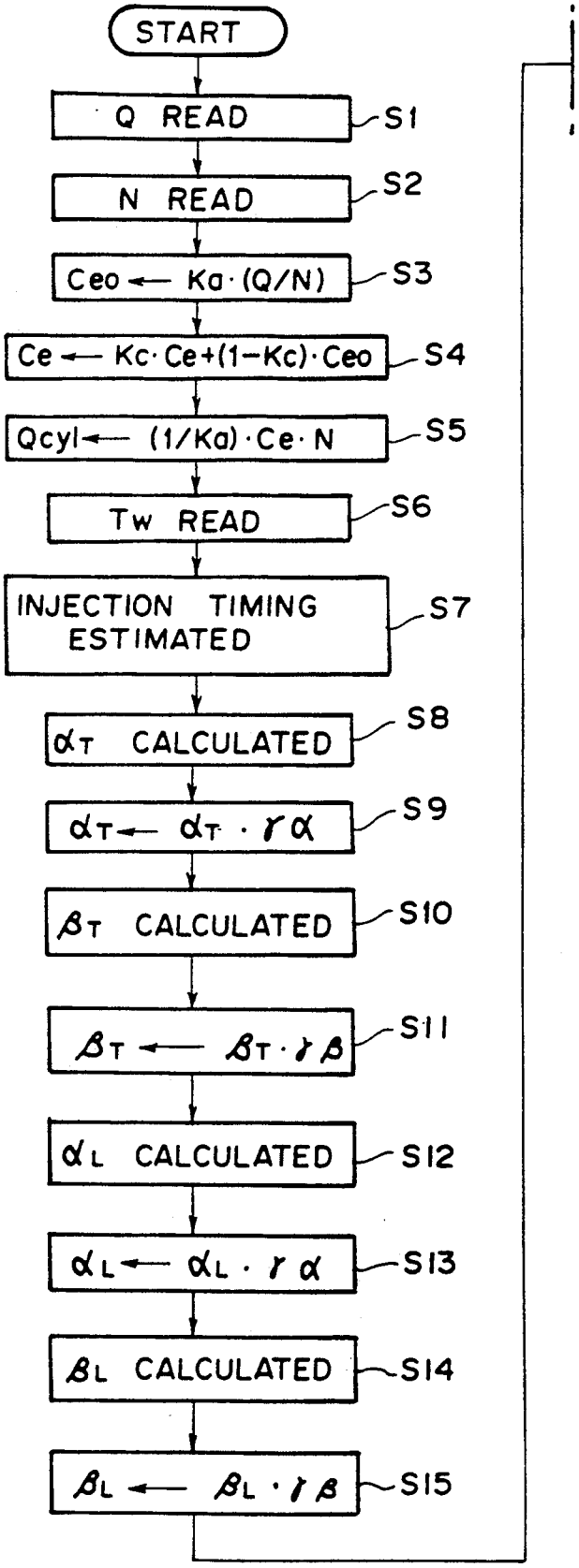
FIGS. 2, 2A, and 2B are flow chart showing a main routine which the control unit executes.
Figure 2B:
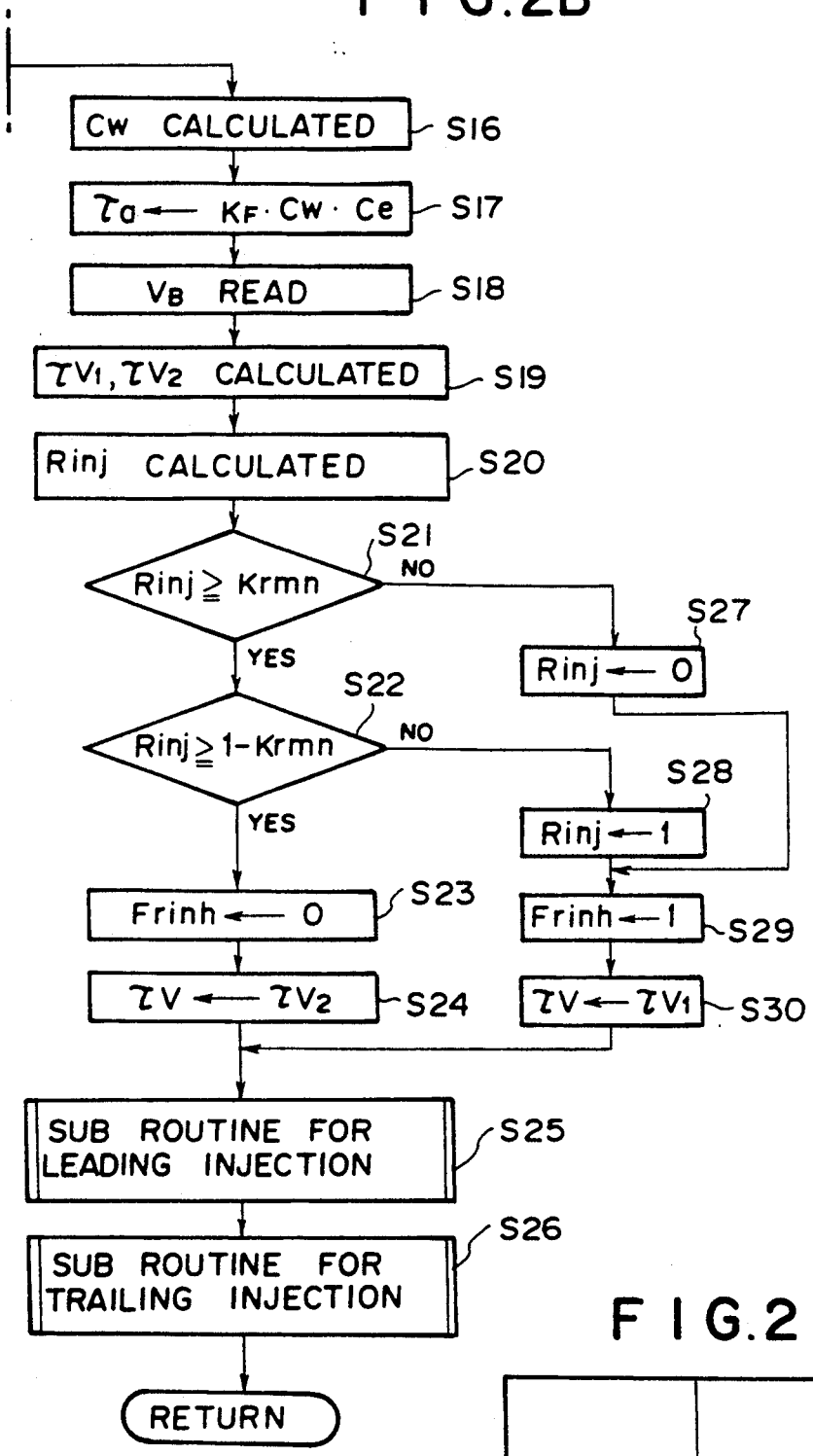
Figure 2:
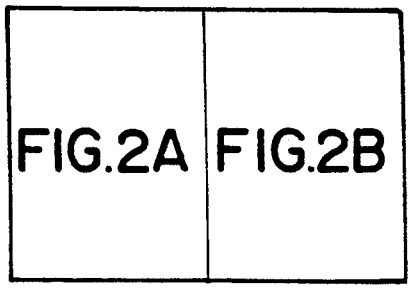

In the main routine shown in FIG. 2, the control unit 10 first reads the output signal Q of the airflow meter 6 in step S1 and reads the engine speed N in step S2. Then in step S3, the control unit 10 calculates the charging efficiency Ceo as detected by the airflow meter according to formula $$CeO = Ka \cdot Q/N$$

wherein Ka is constant. In step S4, the control unit 10 calculates the cylinder charging efficiency Ce according to the following formula.

$$Ce = Kc \cdot Ce + (1 - Kc) \cdot CeO$$

wherein Kc is constant not smaller than 0 and smaller than 1.

In step S5, the control unit 10 calculates the flow speed Qcyl at the fuel injection valve 14 according to formula Qcyl = 1/Ka·Ce·N. In step S6, the control unit 10 reads the engine cooling water temperature Tw.

Then the control unit 10 predicts the fuel injection timing and corrects the proportion of the direct delivery part and the proportion of the drawn part on the basis of the predicted fuel injection timing. (steps S7 to S15)

Figure 5:
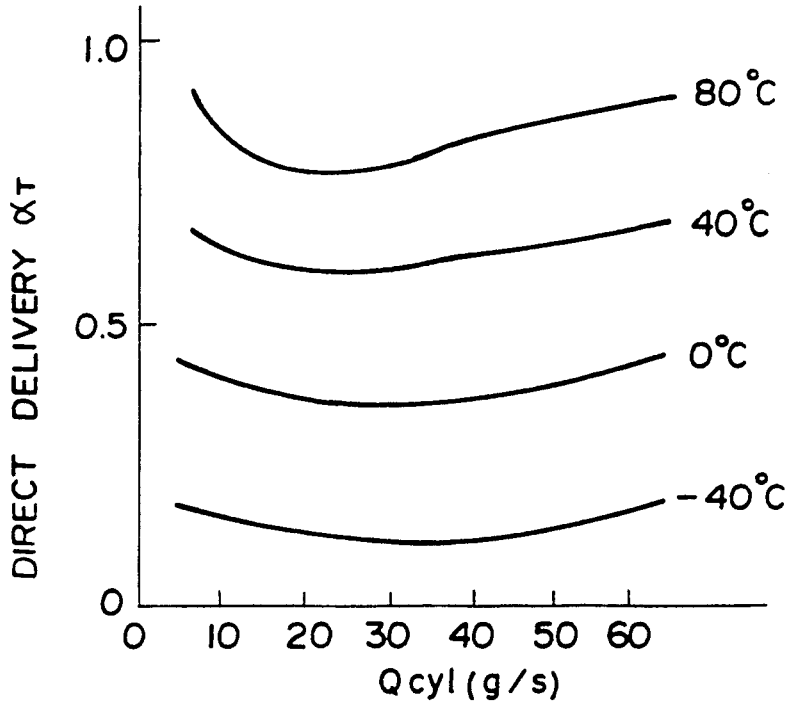
FIG. 5 is a map of the proportion of the directly delivery part for the trailing injection.

That is, in step S7, the control unit 10 predicts the fuel injection timing corresponding to the present operating condition of the engine based on a map (not shown) in which the fuel injection timing is related to the output Q of the airflow meter and the engine speed N. Then the control unit 10 estimates the proportion of the direct delivery part $\alpha T$ for the trailing injection or for the injection effected in the intake stroke (In this embodiment, divided injection method is employed.) according to the map shown in FIG. 5 in which the flow speed Qcyl at the fuel injection valve and the water temperature Tw are used as parameters. (step S8) Then the control unit 10 obtains a correction value $\gamma\alpha$ corresponding to the predicted fuel injection timing according to the map shown in FIG. 9, and corrects the estimated proportion of the direct delivery part $\alpha_T$ with the correction value $\gamma\alpha$, and employs the corrected value as the proportion of the direct delivery part $\alpha_T$ in the subsequent control ($\alpha_T \leftarrow \alpha_T \cdot \gamma\alpha$)· (step S9).

Figure 6:
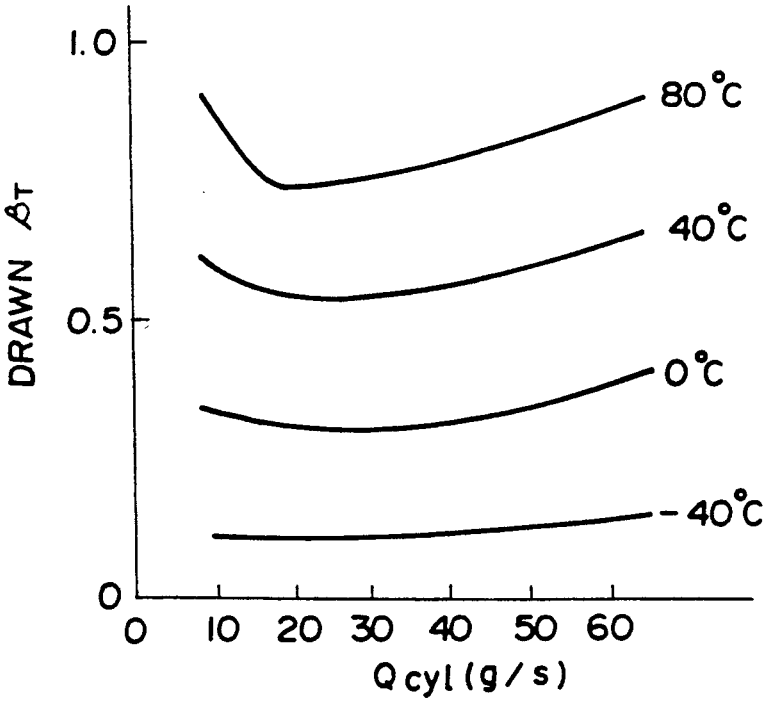
FIG. 6 is a map of the proportion of the drawn part for the trailing injection.

Then the control unit 10 estimates the proportion of the drawn part $\beta_T$ for the trailing injection or for the injection effected in the intake stroke according to the map shown in FIG. 6 in which the flow speed Qcyl at the fuel injection valve and the water temperature Tw are used as parameters. (step S10) Then the control unit 10 obtains a correction value $\gamma\beta$ corresponding to the predicted fuel injection timing according to the map shown in FIG. 10, and corrects the estimated proportion of the drawn part $\beta_T$ with the correction value $\gamma\beta$, and employs the corrected value as the proportion of the drawn part $\beta T$ in the subsequent control ($\beta T \leftarrow \beta T \cdot \gamma\beta$). (step S11)

Figure 7:
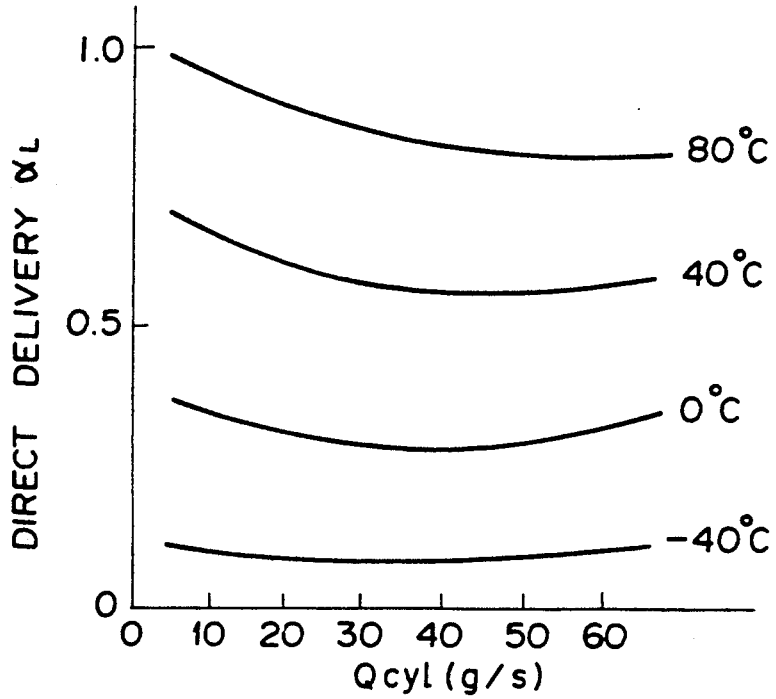
FIG. 7 is a map of the proportion of the directly delivery part for the leading injection.

Then the control unit 10 estimates the proportion of the direct delivery part $\alpha_L$ for the leading injection or for the injection effected in the power stroke according to the map shown in FIG. 7 in which the flow speed Qcyl at the fuel injection valve and the water temperature Tw are used as parameters. (step S12) Then the control unit 10 corrects the estimated proportion of the direct delivery part $\alpha_L$ with the correction value $\gamma\alpha$, and employs the corrected value as the proportion of the direct delivery part $\alpha_L$ in the subsequent control ($\alpha_{T+\alpha L} \cdot \gamma\alpha$)·(step S13)

Figure 8:
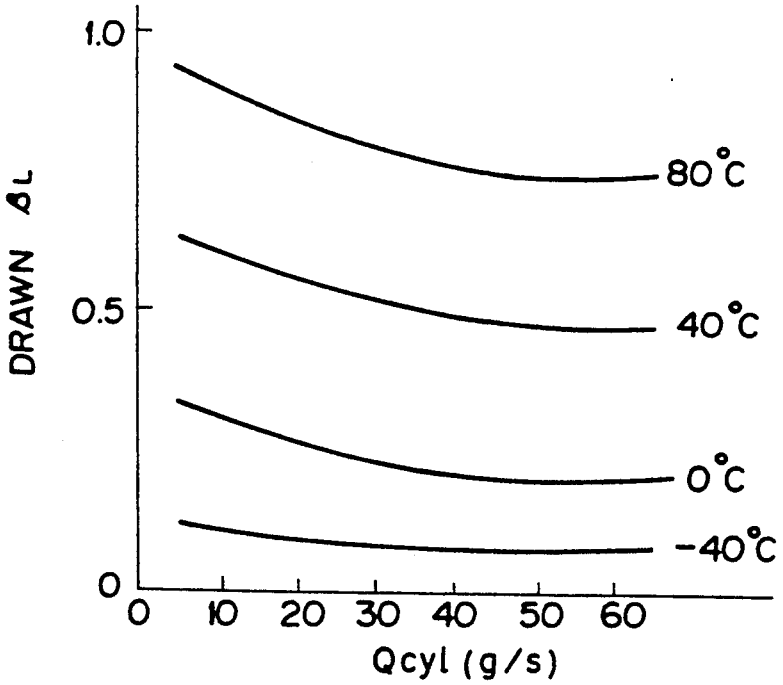
FIG. 8 is a map of the proportion of the drawn part for the leading injection.

Then the control unit 10 estimates the proportion of the drawn part $\beta L$ for the leading injection or for the injection effected in the power stroke according to the map shown in FIG. 8 in which the flow speed Qcyl at the fuel injection valve and the water temperature Tw are used as parameters. (step S14) Then the control unit 10 corrects the estimated proportion of the drawn part $\beta_L$ with the COrrection value $\gamma\beta$, and employs the corrected value as the proportion of the drawn part $\beta_L$ in the subsequent control ($\beta L \leftarrow \beta L \cdot \gamma\beta$)· (step S15)

Figure 9:
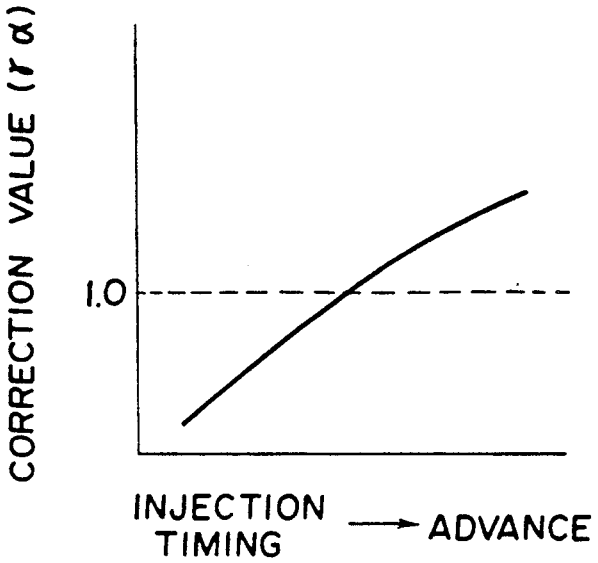
FIGS. 9 and 10 are maps of the correction values for correcting the estimated direct delivery part and the estimated drawn part according to the fuel injection timing.
Figure 10:
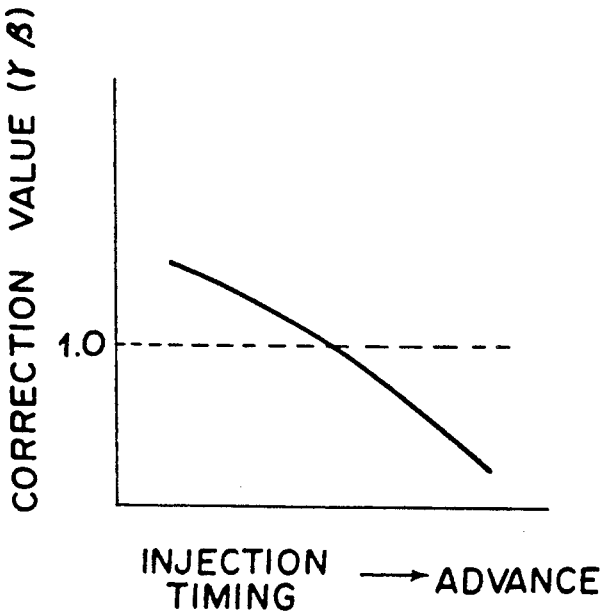

The correction value $\gamma\alpha$ for correcting the direct delivery parts $\alpha_T$ and $\alpha_L$ is increased as the fuel injection timing is retarded as shown in FIG. 9, and the correction value $\gamma\beta$ for correcting the drawn parts $\beta_T$ and $\beta_L$ is increased as the fuel injection timing is advanced as shown in FIG. 10. This is because the later the fuel injection timing is, i.e., the wider the opening degree of the intake valve during fuel injection is, the more the direct delivery part is, and the earlier the fuel injection timing, the period before the intake valve is opened and fuel is introduced into the combustion chamber, i.e., the period during which wetting fuel vaporizes, becomes longer and the drawn part increases.

Though it is preferred that both the direct delivery part and the drawn part be corrected according to the fuel injection timing as in this embodiment, only one of them may be corrected.

Figure 21:
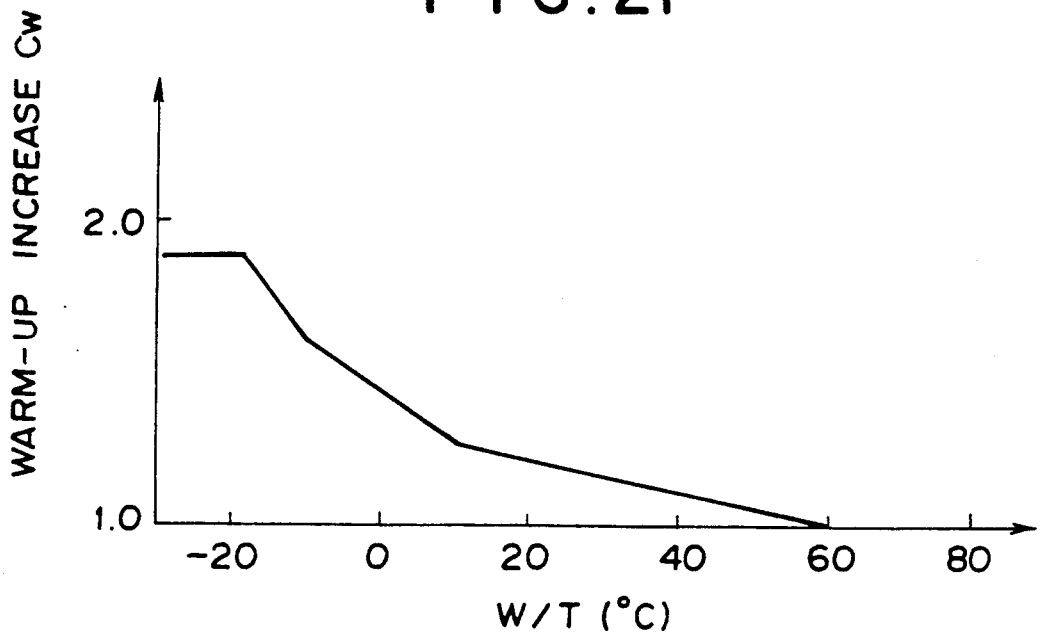
FIG. 21 is a fuel increase for warm-up-water temperature characteristic map.
Figure 22:
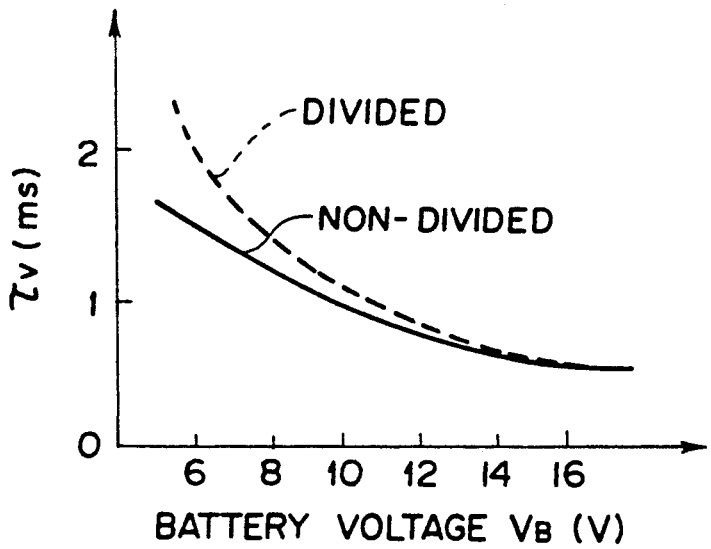
FIG. 22 is an ineffective injection time battery voltage characteristic map.
Figure 23:
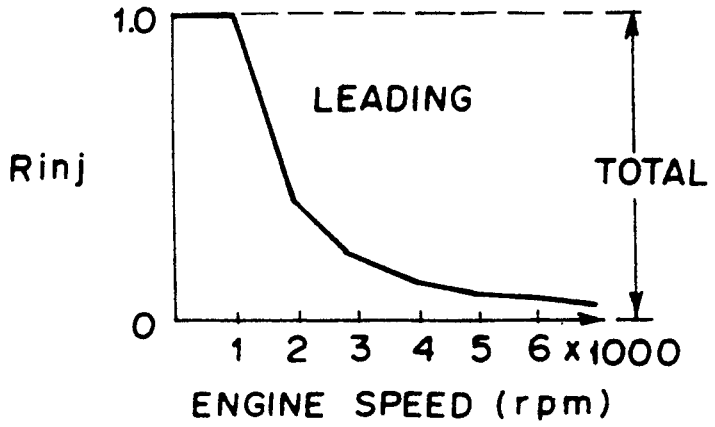
FIG. 23 is a dividing ratio characteristic map.

Then in step S16, the control unit 10 calculates the fuel increase for warm-up Cw according to the map shown in FIG. 21 on the basis of the temperature of the cooling water Tw. In step S17, the control unit 10 calculates the basic fuel injection pulse width $\tau a$ by multiplying together the fuel increase for warm-up Cw, the cylinder charging efficiency Ce which was calculated in step S4 and a fuel injection constant $K_f$. That is, $\tau a = K_F \cdot Cw \cdot Ce$ After calculating the basic fuel injection pulse width $\tau a$, the control unit 10 reads the battery voltage $V_B$ in step S18, and calculates, in step S19, an ineffective injection time for the non-divided fuel injection $\tau V1$ and that for divided fuel injection $\tau V2$ on the basis of the battery voltage $V_B$ according to the map shown in FIG. 22. In step S20, the control unit 10 calculates the dividing ratio $R_{inj}$ (=the quantity of fuel to be injected by the trailing injection/the total quantity of fuel to be injected) according to the map shown in FIG. 23 on the basis of the engine speed N from.

Then in step S21, the control unit 10 determines whether the dividing ratio $R_{inj}$ is not smaller than a minimum dividing ratio $K_{rmn}$. The minimum dividing ratio $K_{rmn}$ is larger than 0 and smaller than 1. When it is determined that the dividing ratio $R_{inj}$ is not smaller than a minimum dividing ratio $K_{rmn}$, the control unit 10 determines whether the dividing ratio $R_{inj}$ is not larger than 1 minus the minimum dividing ratio $K_{rmn}$. ( step S22) When it is determined in step S22 that the dividing ratio $R_{inj}$ is not smaller than 1 minus the minimum dividing ratio $K_{rmn}$, the control unit 10 sets a division inhibiting flag $F_{rinh}$ to 0. ( step S23) Then in step S24, the control unit 10 sets the ineffective injection time for divided fuel injection $\tau V2$ to an ineffective injection time $\tau V$ which is a practical value. The control unit 10 executes the sub routine for the leading injection shown in FIG. 3 in step S25 and executes the sub routine for the trailing injection shown in FIG. 4 in step S26.

When it is determined in step step S21 that the dividing ratio $R_{inj}$ is smaller than a minimum dividing ratio $K_{rmn}$, the control unit 10 nullifies the dividing ratiO $R_{inj}$ in step S27, that is, the control unit 10 causes the fuel injection valve 4 to inject the total quantity of fuel to be injected solely by the leading injection. When it is determined in step S22 that the dividing ratio $R_{inj}$ is smaller than 1 minus the minimum dividing ratio $K_{rmn}$, the control unit 10 sets the dividing ratio $R_{inj}$ to 1 in step S28, that is, the control unit 10 causes the fuel injection valve 4 to inject the total quantity of fuel to be injected solely by the trailing injection. Then the control unit 10 sets the division inhibiting flag $F_{rinh}$ to 1 in Step S29 and sets in step S30 the ineffective injection time for non-divided fuel injection $\tau V1$ to the ineffective injection time $\tau V$ which is a practical value. Thereafter, the control unit 16 proceeds to steps S25 and S26.

The sub routine for the leading injection for a N-th cylinder will be described with reference to FIG. 3, hereinbelow.

In this sub routine, the control unit 10 determines in step S31 whether wet correction inhibiting counter $C_{wet}$ is 0. When it is determined in step S30 that the wet correction inhibiting counter $C_{wet}$ is 0, the control unit 10 calculates, in step S32, the wet correction injection pulse width $\tau eN$ for N-th cylinder according to formula $\tau eN = (\tau a - \beta_L \cdot \tau mN)/\alpha_L$, wherein $\tau m$ represents the quantity of the intake-manifold wetting fuel. Otherwise, the control unit 10 sets $\tau eN$ to the basic fuel injection pulse width $\tau a$ in step S33.

Thereafter the control unit 10 determines in step S34 whether the division inhibiting flag $F_{rinh}$ is 0. When it is determined that the division inhibiting flag $F_{rinh}$ iS 0, the control unit 10 calculates in step S35 the leading injection pulse width $\tau e_L N$ on the basis of the wet correction injection pulse width $\tau eN$ and the dividing ratio $R_{inj}$. Then in step S36, the control unit 10 subtracts the leading injection pulse width $\tau eLN$ from the wet correction injection pulse width $\tau eN$, thereby obtaining an initial value of the trailing injection pulse width $\tau e_T N$.

In Step S37, the control unit 10 determines whether the initial value of the trailing injection pulse width $\tau e_T N$ is not smaller than a minimum limit $K_{tmn}$ of the pulse width. When it is determined in step S37 that the initial value of the trailing injection pulse width $\tau e_T N$ is smaller than a minimum limit $K_{tmn}$ of the pulse width, the control unit 10 sets the trailing injection pulse width $\tau eTN$ to the minimum limit $K_{tmn}$ in step S46. Then in step S47, the control unit 10 subtracts the trailing injection pulse width $\tau e_T N$ from the wet correction injection pulse width $\tau eN$ and sets the leading injection pulse width $\tau eLN$ to the value obtained. On the other hand, when it is determined in step S37 that the initial value of the trailing injection pulse width $\tau eTN$ is not smaller than a minimum limit $K_{tmn}$ of the pulse width, the control unit 10 determines in step S38 whether the leading injection pulse width $\tau e_L N$ is not smaller than the minimum limit $K_{tmn}$ of the pulse width. When it is determined that the leading injection pulse width $\tau e_L N$ is not smaller than the minimum limit $K_{tmn}$ of the pulse width, the control unit 10 directly proceeds to step S50 and otherwise, the control unit 10 proceeds to step S50 by way of steps S48 and S49. In steps S48 and S49, the control unit 10 sets the leading injection pulse width $\tau e_L N$ to the minimum limit $K_{tmn}$ and sets trailing injection pulse width $\tau e_T N$ to the value obtained by Subtracting the leading injection pulse width $\tau e_L N$ set in step S48 from the wet correction injection pulse width $\tau eN$. In step S50, the control unit 10 calculates the rest time past of the fuel injection valve 4 according to the following formula.

$$\tau rst = (60/N) - (\tau eLN + \tau v)$$

wherein $\tau v$ represents the ineffective injection time.

When it is determined in step S34 that the division inhibiting flag $F_{rinh}$ is not 0, the control unit 10 determines in step S39 whether the dividing ratio $R_{inj}$ is 0, that is, the fuel injection valve 4 is to inject the total quantity of fuel to be injected solely by the leading injection. When the answer to this question is YES, the control unit 10 sets the leading injection pulse width $\tau e_L N$ to the wet correction injection pulse width $\tau eN$ as it is and sets the trailing injection pulse width $\tau e_T N$ to 0. (steps S40 and S41)

Then in step S44, the control unit 10 determines whether the leading injection pulse width $\tau e_L N$ is not smaller than the minimum limit $K_{tmn}$ of the pulse width. When the answer to this question is YES, the control unit 10 directly proceeds to step S50. Otherwise the control unit 10 proceeds to step S50 after setting the leading injection pulse width $\tau e_L N$ to the minimum limit $K_{tmn}$ of the pulse width in step S45.

After step S50, the control unit 10 determines in step S51 whether the rest time $\tau rst$ of the fuel injection valve 4 is not smaller than a minimum limit Ktrst of the rest time. When the answer to this question is YES, the control unit 10 sets a trailing injection inhibiting flag $F_{tinhN}$ to 0 in step S52, and otherwise, sets in step S53 the leading injection pulse width $\tau e_L N$ to the the wet correction injection pulse width $\tau eN$ as it is. Then control unit 10 sets the trailing injection inhibiting flag $F_{tinhN}$ to 1 in step S54.

Thereafter the control unit 10 resets a timer $T_{injN}$ in step S55, and in step S56, the control unit 10 sets the ending time of the injection or the pulse width $T_{endN}$ to the value obtained by adding the ineffective injection time $\tau v$ to the leading injection pulse width $\tau e_L N$. Then the control unit 10 causes the fuel injection valve 4 to inject fuel in step S58 after setting an injection start signal $F_{injN}$ to 1 in step S57.

When it is determined in step S30 that the dividing ratio $R_{inj}$ is not 0, the control unit 10 sets the trailing injection inhibiting flag $F_{tinhN}$ to 0 in step S42 and sets in step S43 the trailing injection pulse width $\tau e_T N$ to the the wet correction injection pulse width $\tau eN$ as it is.

Further, in step S59, the control unit 10 calculates an effective dividing ratio $R_{injN}$ according tO formula $$1-(\tau eLn/\tau eN)$$

and then calculates in step S60 the pulse width allotted to the leading injection $\tau a_L N$ in the basic injection pulse width $\tau a$ according to the following formula.

$$\tau aLN = (1 - R_{injN}) \cdot \tau a$$

Then the control unit 10 calculates in step S61 the total quantity of fuel $\tau_{CLN}$ to be fed to the cylinder by the leading injection according to the following formula.

$$\tau CLN = \alpha L \cdot \tau eLN + \beta L \cdot \tau mN$$

Finally the control unit 10 calculates in step S62 the quantity of the intake manifold wetting fuel after the leading injection $\tau m_{LN}$ according to the following formula.

$$\tau m_{LN} = (1 - \alpha L)\tau eLN + (1 - R_{injN}) \cdot (1\alpha L)\tau mN$$

The sub routine for the trailing injection for a N-th cylinder will be described with reference to FIG. 4, hereinbelow.

In step S63, the control unit 10 determines whether the quantity of fuel corresponding to the basic injection pulse width $\tau a$ is not smaller than the quantity of fuel $\tau_{cLN}$ which is fed to the cylinder by the leading injection. When it is determined that the former is not smaller than the latter, the control unit 10 determines in step S64 whether wet correction inhibiting counter $C_{wet}$ is 0. When it is determined in step S64 that the wet correction inhibiting counter $C_{wet}$ is 0, the control unit 10 determines in step S65 whether trailing injection inhibiting flag $F_{tinhN}$ is 0. When it is determined that - the trailing injection inhibiting flag $F_{tinhN}$ is 0, the control unt 10 calculates the wet correction injection pulse width $\tau eN$ for N-th cylinder according to the following formula in step S66.

$$\tau eN = (\tau a - \beta_T \tau mN) \cdot / \alpha_T$$

In the next step S67, the control unit 10 calculates the trailing injection pulse width $\tau e_T N$ in the divided injection according to the following formula.

$$\tau eTN=(\tau a-\tau aLN-R_{injN}\cdot\beta T\cdot\tau mN)/\alpha T$$

wherein $\tau a_L N$ represents the pulse width allotted to the leading injection $\tau a_L N$ and $R_{injN}$ represents the effective dividing ratio $R_{injN}$.

Thereafter, the control unit 10 determines in step S70 whether the division inhibiting flag $F_{rinh}$ is 0. When it is determined that the division inhibiting flag $F_{rinh}$ is 0, the control unit 10 determines in step S71 whether the trailing injection pulse width $\tau e_T N$ is not smaller than a minimum limit $K_{tmn}$ of the pulse width. When it is determined in step S71 that the trailing injection pulse width $\tau e_T N$ is not smaller than a minimum limit $K_{tmn}$ of the pulse width, the control unit 10 calculates the rest time $\tau rst$ of the fuel injection valve 4 according to the following formula.

$$\tau rst=(60/N)-(\tau eTN+\tau V)$$

wherein $\tau v$ represents the ineffective injection time.

In step S81, the control unit 10 determines whether the rest time $\tau rst$ of the fuel injection valve 4 is not smaller than a minimum limit Ktrst of the rest time. When the answer to this question is NO, the control unit 10 calculates in step S82 the trailing injection pulse width $\tau e_T N$ according to formula $$\tau eTN=(60/N)-(Ktrst+\tau v),$$

and then proceeds to step S83. Otherwise, the control unit 10 directly proceeds to step S83.

In step S83, the control unit 10 resets a timer $T_{injN}$, and in Step S84, the control unit 10 sets the ending time of the injection or the pulse width $T_{endN}$ to the value obtained by adding the ineffective injection time $\tau v$ to the trailing injection pulse width $\tau e_T N$. Then the control unit 10 causes the fuel injection valve 4 to inject fuel in step S87 after setting an injection start signal $F_{injN}$ to 1 in step S86.

Finally the control unit 10 calculates in step S89 the total quantity of the intake-manifold wetting fuel $\tau m_N$ according to the following formula.

$$\tau mN=(-\alpha T)\tau eTN+R_{injN}\cdot(1-\beta T)\cdot\tau mN+\tau mLN$$

When the answer to the question in step S63 is NO, the control unit 10 proceeds to step S89.

When the answer to the question in step S64 is NO, that is, when the wet correction is not to be made, the control unit 10 sets $\tau eN$ to the basic fuel injection pulse width $\tau a$ in step S72. Thereafter the control unit 10 determines in step S73 whether the trailing injection inhibiting flag $F_{tinhN}$ is 0. When it is determined that the trailing injection inhibiting flag $F_{tinhN}$ is 0, the control unit 10 subtracts the leading injection pulse width $\tau a_L N$ from the basic injection pulse width $\tau a$, and sets the trailing injection pulse width $\tau eTN$ to the difference. ( step S74) Thereafter the control unit 10 proceeds to step S70.

When the answer to the question in step S65 is NO, that is, when the trailing injection is inhibited, the control unit 10 calculates in step S68 the wet correction injection pulse width $\tau eN$ according to the following formula.

$$\tau eN=\tau a-\beta L\cdot mN$$

Then in step S69, the control unit 10 sets the leading injection pulse width $\tau e_L N$ to the wet correction injection pulse width $\tau eN$ obtained in step S68, and sets the trailing injection pulse width $\tau e_T N$ to 0. In step S85, the control unit 10 sets the ending time of the injection or the pulse width $T_{endN}$ to the value obtained by adding the ineffective injection time rv to the leading injection pulse width $\tau e_L N$. Then the control unit 10 proceeds to step S89 after extending the leading injection time in step S88.

When it is determined in step S70 that the division inhibiting flag $F_{rinh}$ is not 0, that is, when the divided injection is not to be effected, the control unit 10 determines in step S75 whether the dividing ratio $R_{inj}$ is 1, that is, which is to be effected the leading injection or the trailing injection. When it is determined that the dividing ratio $R_{inj}$ is 1, the control unit 10 determines in step S76 whether the wet correction injection pulse width $\tau eN$ is not smaller than the minimum limit $K_{tmn}$ of the pulse width. When it is determined that the wet correction injection pulse width $\tau eN$ is not smaller than the minimum limit $K_{tmn}$ of the pulse width, the control unit 10 sets in step S78 the trailing injection pulse width $\tau e_T N$ to the wet correction injection pulse width $\tau eN$ and then proceeds to step S80. Otherwise, the control unit 10 sets in step S77 the trailing injection pulse width $\tau e_T N$ to the minimum limit $K_{tmn}$ of the pulse width and then proceeds to step S80.

When the answer to the question in step S71 is NO, the control unit 10 proceeds to step S80 after executing step S77.

Though, in the embodiment described above, the estimated values of the drawn part and direct delivery part are changed according to the fuel injection timing, i.e., the length of the period during which the fuel vaporizes, they may be changed according to other factors as described above.

Figure 11:
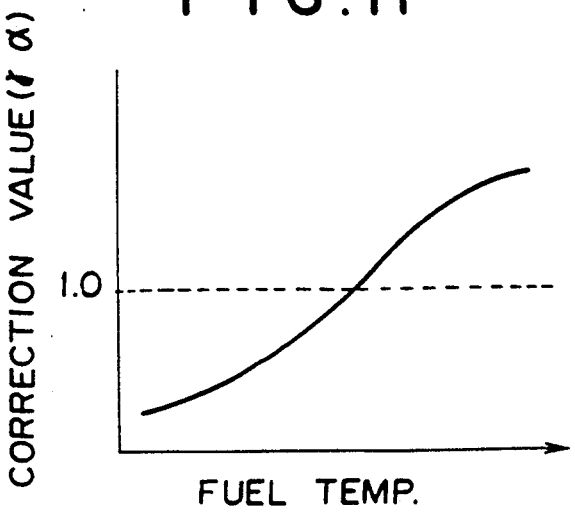
FIGS. 11 and 12 are maps of the correction values for correcting the estimated direct delivery part and the estimated drawn part according to the temperature of fuel.
Figure 12:
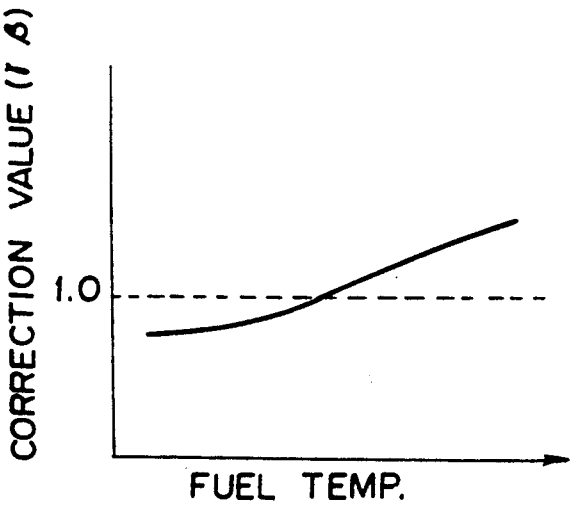

FIG. 11 shows an example of the correction value $\gamma\alpha$ in the case where the direct delivery parts $\alpha_T$ and $\alpha_L$ are corrected according to the temperature of fuel, and FIG. 12 shows an example of the correction value $\gamma\beta$ in the case where the drawn parts $\beta_T$ and $\beta_L$ are corrected according to the temperature of fuel. In this case, the correction value $\gamma\alpha$ for the direct delivery part is increased with increase in the fuel temperature at a rate higher than the correction value $\gamma\beta$ for the drawn part. This is because the fuel comes to vaporize better with increase in the fuel temperature and the proportion of the intake-manifold wetting fuel is reduced.

Figure 13:
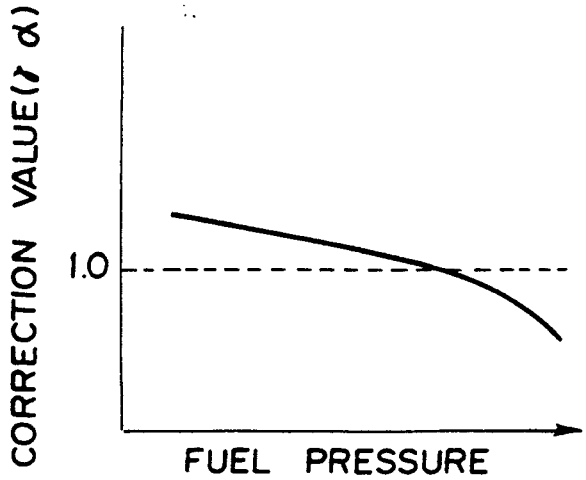
FIGS. 13 and 14 are maps of the correction values for correcting the estimated direct delivery part and the estimated drawn part according to the fuel pressure.
Figure 14:
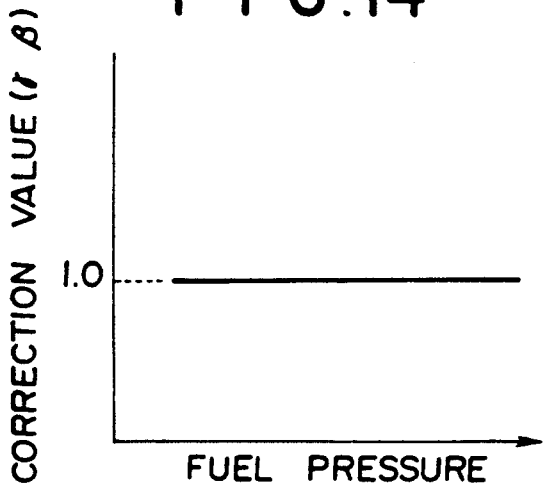

FIG. 13 shows an example of the correction value $\gamma\alpha$ in the case where the direct delivery parts $\alpha_T$ and $\alpha_L$ are corrected according to the fuel pressure, and FIG. 14 shows an example of the correction value $\gamma\beta$ in the case where the drawn parts $\beta_T$ and $\beta_L$ are corrected according to the fuel pressure. In this case, though the correction value $\gamma\alpha$ for the direct delivery part is reduced with increase in the fuel pressure, the correction value $\gamma\beta$ for the drawn part is kept constant irrespective of the fuel pressure as can be understood from FIGS. 13 and 14. This is because as the fuel pressure increases, the fuel injected from the injector 4 becomes more apt to adhere to the wall surface of the intake passage 2 and the proportion of the direct delivery part is reduced, whereas the proportion of the drawn part is hardly affected by the fuel pressure per se.

Figure 15:
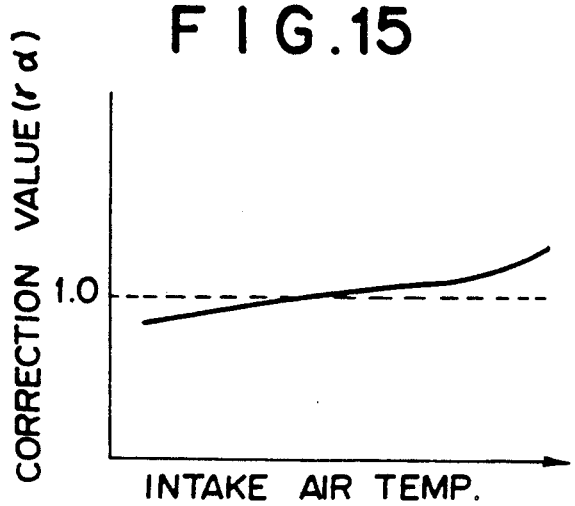
FIGS. 15 and 16 are maps of the correction values for correcting the estimated direct delivery part and the estimated drawn part according to the temperature of intake air.
Figure 16:
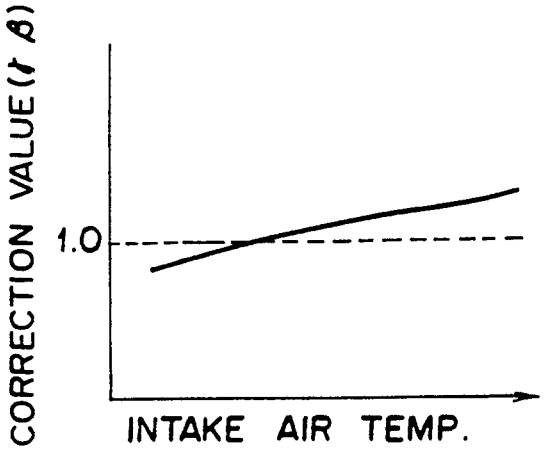

FIG. 15 shows an example of the correction value $\gamma\alpha$ in the case where the direct delivery parts $\alpha_T$ and $\alpha_L$ are corrected according to the temperature of intake air, and FIG. 16 shows an example of the correction value $\gamma\beta$ in the case where the drawn part $\beta_T$ and $\beta_L$ are corrected according to the temperature of intake air. In this case, the correction values $\gamma\alpha$ and $\gamma\beta$ are both gradually increased with increase in the temperature of intake air. This is because the fuel comes to vaporize better with increase in the temperature of intake air.

Figure 17:
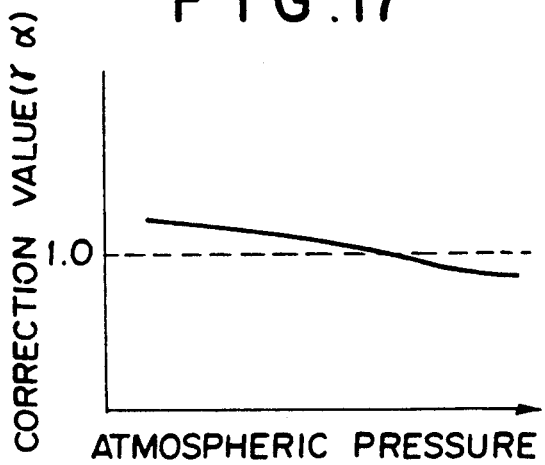
FIGS. 17 and 18 are maps of the correction values for correcting the estimated direct delivery part and the estimated drawn part according to the atmospheric pressure.
Figure 18:
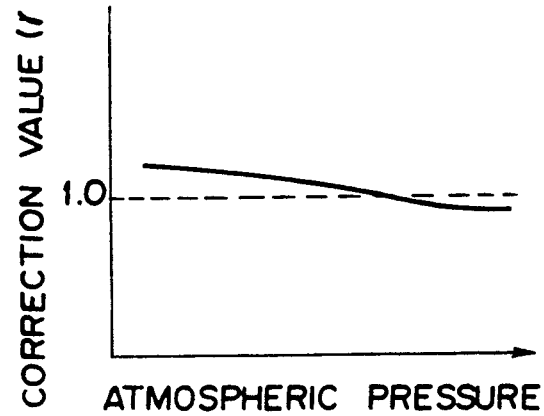

FIG. 17 shows an example of the correction value $\gamma\alpha$ in the case where the direct delivery parts $\alpha_T$ and $\alpha_L$ are corrected according to the atmospheric pressure, and FIG. 18 shows an example of the correction value $\gamma\beta$ in the case where the drawn part $\beta_T$ and $\beta_L$ are corrected according to the atmospheric pressure. In this case, the correction values $\gamma\alpha$ and $\gamma\beta$ are both gradually reduced with increase in the atmospheric pressure. This is because the fuel comes to vaporize better with decrease in the atmospheric pressure.

Figure 19:
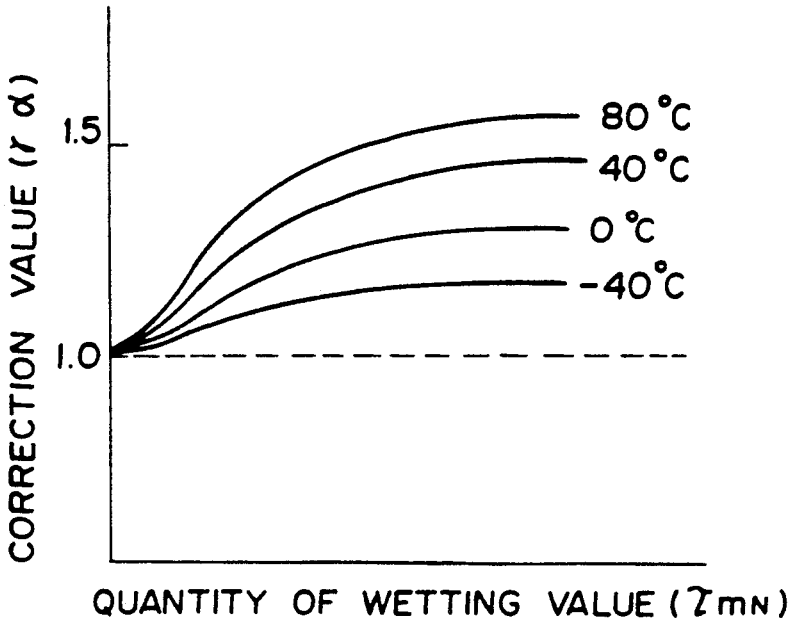
FIGS. 19 and 20 are maps of the correction values for correcting the estimated direct delivery part and the estimated drawn part according to the quantity of the intake-manifold wetting fuel.
Figure 20:
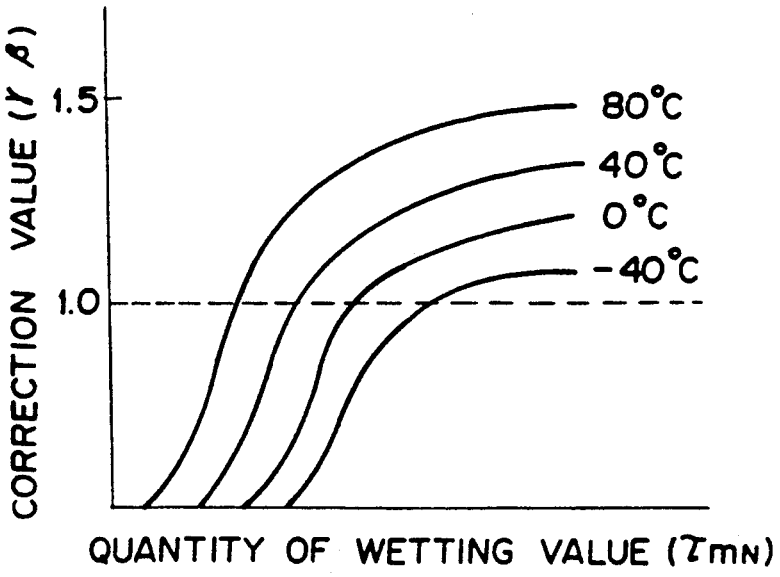

FIG. 19 shows an example of the correction value $\gamma\alpha$ in the case where the direct delivery parts $\alpha_T$ and $\alpha_L$ are corrected according to both the quantity of the intake-manifold wetting fuel and the temperature of intake air, and FIG. 20 shows an example of the correction value $\gamma\beta$ in the case where the drawn parts $\beta_T$ and $\beta_L$ are corrected according to both the quantity of the intake-manifold wetting fuel and the temperature of intake air. In this case, the correction value $\gamma\alpha$ is never smaller than 1.0 and is increased with increase in the quantity of the intake-mainfold wetting fuel and with increase in the temperature of intake air. This is because as the quantity of the intake-manifold wetting fuel increases, the wall surface of the intake passage 2 is more smoothed and more part of the injected fuel is directly fed to the combustion chamber and because the fuel comes to vaporize better with increase in the temperature of intake air. The correction value $\gamma\beta$ is also increased with increase in the quantity of the intake-manifold wetting fuel and with increase in the temperature of intake air for substantially the same reason, but in the range where the quantity of the intake-manifold wetting fuel is small, the correction value $\gamma\beta$ is smaller than 1.0. This is, because when the quantity of the intake-manifold wetting fuel is small, a part of the intake-manifold wetting fuel enters the recesses and contact of the fuel in the recesses with airflow passing through the intake passage becomes worse and the degree of evaporation is lowered.

Figure 25:
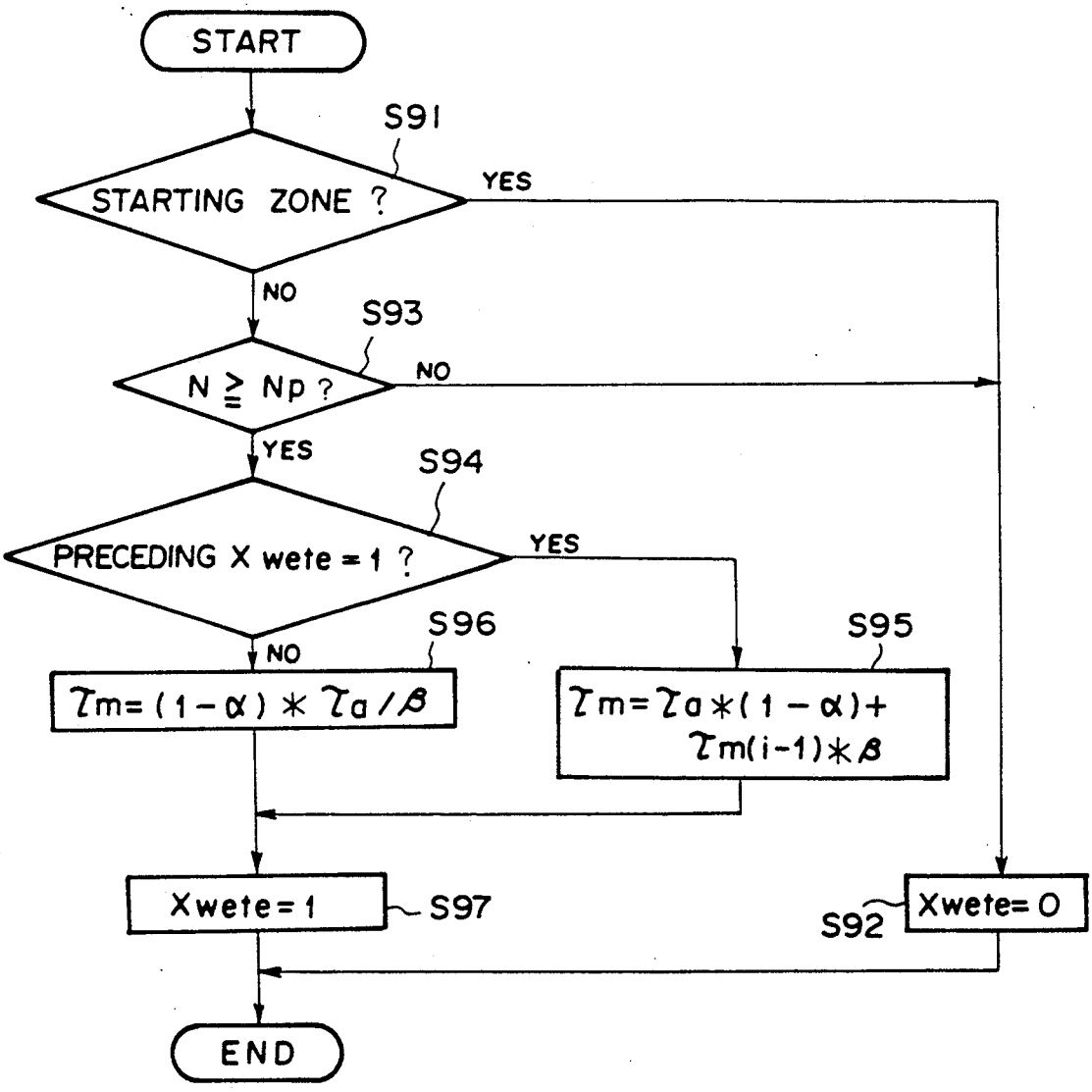
FIG. 25 is a flow chart for illustrating another embodiment of the present invention.

When the engine is started up, fuel is generally increased to facilitate start of the engine and at the same time and the quantity of the intake-manifold wetting fuel is very small. Accordingly, estimation of the direct delivery part and the drawn part is very difficult and it is preferred that the wet correction be not effected for a predetermined time after the engine is started. FIG. 25 shows a sub routine for inhibiting the wet correction until the engine speed reaches a predetermined value.

The control unit 10 first determines whether the operating condition of the engine is in the starting zone in which, for instance, the engine speed N is lower than 500rpm. (step S91) When it is determined that the operating condition of the engine is in the starting zone, the control unit 10 sets wet correction flag Xwet to 0 in order to inhibit the wet correction and keeps the flag Xwet at 0 until the engine speed N reaches a predetermined value Np (e.g., 1200rpm). (steps S92 and S93) When the engine speed N reaches the predetermined value for the first time, the control unit 10 sets an initial value of the wet correction pulse width $\tau m$ according to the following formula.

$$\tau m=(1-\alpha)\cdot\tau a/\beta$$

This formula is derived from formula $\tau e=(\tau a-\beta\cdot\tau m)/\alpha$ (wherein $\tau e$ represents fuel injection pulse width to be actually output) by substituting $\tau a$ for $\tau e$ on the presumption that there is no intake-manifold wetting fuel. Thereafter, the control unit 10 sets the wet correction pulse width $\tau na$ according to the following formula.

$$\tau m=\tau a\cdot(1-\alpha)+\tau m(i-1)\cdot\beta$$

wherein $\tau m(i-1)$ is the preceding value of $\tau m$. (steps S95 to S97)

We claim:

1. A fuel control system for an engine having a fuel injection means which injects fuel into an intake passage communicating with a combustion chamber, in which the quantity of a direct delivery part of the fuel injected from the fuel injection means which is directly fed to the combustion chamber is estimated, the quantity of a drawn part of fuel which has been on a wall surface of the intake passage and is vaporized and fed to the combustion chamber together with the direct delivery part is estimated, and the quantity of fuel to be injected from the fuel injection means is determined on the basis of the estimated quantities of the direct delivery part and the drawn part so that the sum of them provides a desired quantity of fuel to be fed to the combustion chamber comprising:

a vaporizing condition detecting means which detects at least one of factors which govern the degree of evaporation of the fuel on the wall surface, and a changing means which increase the estimated quantity of at least one of the direct delivery part and the drawn part as the factor changes in such a direction as to promote evaporation of the fuel on the wall surface;

wherein said factor is the fuel injection timing and the changing means increases the estimated quantity of the direct delivery part as the fuel injection timing is retarded.

2. A fuel control system for an engine having a fuel injection means which injects fuel into an intake passage communicating with a combustion chamber, in which the quantity of a direct delivery part of the fuel injected from the fuel injection means which is directly fed to the combustion chamber is estimated, the quantity of a drawn part of fuel which has been on a wall surface of the intake passage and is vaporized and fed to the combustion chamber together with the direct delivery part is estimated, and the quantity of fuel to be injected from the fuel injection means is determined on the basis of the estimated quantities of the direct delivery part and the drawn part so that the sum of them provides a desired quantity of fuel to be fed to the combustion chamber comprising:

a vaporizing condition detecting means which detects at least one of factors which govern the degree of evaporation of the fuel on the wall surface, and a changing means which increase the estimated quantity of at least one of the direct delivery part and the drawn part as the factor changes in such a direction as to promote evaporation of the fuel on the wall surface;

wherein said factor is the temperature of the fuel and the changing means increases both the estimated quantities of the direct delivery part and the drawn part as the temperature of the fuel increases, said changing means selecting correction values corresponding to the temperature of the fuel, and obtaining a product of the estimated quantity of the direct delivery part and a correction value, and a product of the estimated quantity of the drawn part and a correction value, with the product forming changed estimated quantities of the direct delivery part and the drawn part.

3. A fuel control system as defined in claim 2 in which said changing means increases the estimated quantity of the direct delivery part at a rate higher than that of the drawn part as the temperature of the fuel increases.

4. A fuel control system for an engine having a fuel injection means which injects fuel into an intake passage communicating with a combustion chamber, in which the quantity of a direct delivery part of the fuel injected from the fuel injection means which is directly fed to the combustion chamber is estimated, the quantity of a drawn part of fuel which has been on a wall surface of the intake passage and is vaporized and fed to the combustion chamber together with the direct delivery part is estimated, and the quantity of fuel to be injected from the fuel injection means is determined on the basis of the estimated quantities of the direct delivery part and the drawn part so that the sum of them provides a desired quantity of fuel to be fed to the combustion chamber comprising:

a vaporizing condition detecting means which detects at least one of factors which govern the degree of evaporation of the fuel on the wall surface, and a changing means which increase the estimated quantity of at least one of the direct delivery part and the drawn part as the factor changes in such a direction as to promote evaporation of the fuel on the wall surface;

wherein sad factor is the fuel pressure and the changing means increases the estimated quantity of the direct delivery part as the fuel pressure is reduced.

5. A fuel control system for an engine having a fuel injection means which injects fuel into an intake passage communicating with a combustion chamber, in which the quantity of a direct delivery part of the fuel injected from the fuel injection means which is directly fed to the combustion chamber is estimated, the quantity of a drawn part of fuel which has been on a wall surface of the intake passage and is vaporized and fed to the combustion chamber together with the direct delivery part is estimated, and the quantity of fuel to be injected form the fuel injection means is determined on the basis of the estimated quantities of the direct delivery part and the drawn part so that the sum of them provides a desired quantity of fuel to be fed to the combustion chamber comprising:

a vaporizing condition detecting means which detects at least one of factors which govern the degree of evaporation of the fuel on the wall surface, and a changing means which increase the estimated quantity of at least one of the direct delivery part and the drawn part as the factor changes in such a direction as to promote evaporation of the fuel on the wall surface;

wherein said factor is the temperature of intake air and the changing means increases both the estimated quantities of the direct delivery part and the drawn part as the temperature of intake air increases, said changing means selecting correction values corresponding to the temperature of the intake air, and obtaining a product of the estimated quantity of the direct delivery part and a correction value, and a product of the estimated quantity of the drawn part and a correction value, with the products forming changed estimated quantities of the direct delivery part and the drawn part.

6. A fuel control system for an engine having a fuel injection means which injects fuel into an intake passage communicating with a combustion chamber, in which the quantity of a direct delivery part of the fuel injected from the fuel injection means which is directly fed to the combustion chamber is estimated, the quantity of a drawn part of fuel which has been on a wall surface of the intake passage and is vaporized and fed to the combustion chamber together with the direct delivery part is estimated, and the quantity of fuel to be injected from the fuel injection means is determined on the basis of the estimated quantities of the direct delivery part and the drawn part so that the sum of them provides a desired quantity of fuel to be fed to the combustion chamber comprising:

a vaporizing condition detecting means which detects at least one of factors which govern the degree of evaporation of the fuel on the wall surface, and a changing means which increase the estimated quantity of at least one of the direct delivery part and the drawn part as the factor changes in such a direction as to promote evaporation of the fuel on the wall surface;

wherein said factor is the atmospheric pressure and the changing means increases both the estimated quantities of the direct delivery part and the drawn part as the atmospheric pressure lowers.

7. A fuel control system for an engine having a fuel injection means which injects fuel into an intake passage communicating with a combustion chamber, in which the quantity of a direct delivery part of the fuel injected from the fuel injection means which is directly fed to the combustion chamber is estimated, the quantity of a drawn part of fuel which has been on a wall surface of the intake passage and is vaporized and fed to the combustion chamber together with the direct delivery part is estimated, and the quantity of fuel to be injected from the fuel injection means is determined on the basis of the estimated quantities of the direct delivery part and the drawn part so that the sum of them provides a desired quantity of fuel to be fed to the combustion chamber comprising:

a vaporizing condition detecting means which detects at least one of factors which govern the degree of evaporation of the fuel on the wall surface, and a changing means which increase the estimated quantity of at least one of the direct delivery part and the drawn part as the factor changes in such a direction as to promote evaporation of the fuel on the wall surface;

wherein said factor is the quantity of the intake manifold wetting fuel and the changing means increases both the estimated quantities of the direct delivery part and the drawn part as the quantity of the intake manifold wetting fuel increase.

8. The fuel control system of claim 2, wherein the changing means selects a first correction value for the direct delivery part and a second correction value for the drawn part.

9. The fuel control system of claim 5, wherein the changing means selects a first correction value for the direct delivery part and a second correction value for the drawn part.

* * * * *